US012758837B2

(12) United States Patent
Arnts

(10) Patent No.: US 12,758,837 B2
(45) Date of Patent: Oct. 13, 2026

(54) FLOATING BASKETBALL HOOP

(71) Applicant: Phillip Arnts, Niceville, FL (US)

(72) Inventor: Phillip Arnts, Niceville, FL (US)

( * ) Notice: Subject to any disclaimer, the term of this patent is extended or adjusted under 35 U.S.C. 154(b) by 150 days.

(21) Appl. No.: 18/816,033

(22) Filed: Aug. 27, 2024

(65) Prior Publication Data

US 2025/0083014 A1 Mar. 13, 2025

Related U.S. Application Data

(60) Provisional application No. 63/581,774, filed on Sep. 11, 2023.

(51) Int. Cl.
*A63B 63/08* (2006.01)
*A63B 63/00* (2006.01)

(52) U.S. Cl.
CPC ..... *A63B 63/083* (2013.01); *A63B 2063/002* (2013.01); *A63B 2210/50* (2013.01); *A63B 2225/605* (2013.01)

(58) Field of Classification Search
CPC . A63B 63/08; A63B 63/083; A63B 2063/086; A63B 2063/002; A63B 2210/50; A63B 2225/093; A63B 2225/605
See application file for complete search history.

(56) References Cited

U.S. PATENT DOCUMENTS

| | | | | |
|---|---|---|---|---|
| 3,469,844 | A | 9/1969 | Sindelar | |
| 3,656,749 | A | 4/1972 | Reyes | |
| 6,899,647 | B2 * | 5/2005 | Chia | A63B 67/007 273/350 |
| D953,459 | S | 5/2022 | Huang | |
| D953,460 | S | 5/2022 | Huang | |
| D960,265 | S * | 8/2022 | Zhu | D21/702 |
| D1,001,217 | S * | 10/2023 | Engler | D21/699 |
| D1,089,413 | S * | 8/2025 | Yu | D21/705 |
| 2005/0197197 | A1 * | 9/2005 | Scott | A63B 63/08 473/173 |
| 2005/0261090 | A1 | 11/2005 | Ciullini | |
| 2021/0260455 | A1 * | 8/2021 | Samp | A63B 63/08 |
| 2025/0083014 | A1 * | 3/2025 | Arnts | A63B 63/083 |

* cited by examiner

*Primary Examiner* — Christopher R Legendre
(74) *Attorney, Agent, or Firm* — Brennan, Manna & Diamond, LLC

(57) ABSTRACT

A stable and free-floating basketball hoop device for playing basketball in a pool with a basketball hoop that has the stability to withstand surrounding water movement. The stable and free-floating basketball hoop device comprises a base component that is configured in a rectangular or circular shape and comprises a rim, net, scoring board, carrying case, and foam sleeve(s) for support. Moreover, the score board component is electric, preferably manufactured with a durable plastic material and airtight feature for batteries or recharging. The net can be removed, and the plastic frame collapsed for storage. Further, the collapsed device can be inserted into the carrying case for ease of transportation and storage.

19 Claims, 3 Drawing Sheets

FLOATING BASKETBALL HOOP

CROSS-REFERENCE TO RELATED APPLICATION

The present application claims priority to, and the benefit of, U.S. Provisional Application No. 63/581,774, which was filed on Sep. 11, 2023, and is incorporated herein by reference in its entirety.

FIELD OF THE INVENTION

The present invention relates generally to the field of floating pool basketball hoop devices. More specifically, the present invention relates to an improved floating basketball hoop for pools device. Accordingly, the present disclosure makes specific reference thereto. Nonetheless, it is to be appreciated that aspects of the present invention are also equally applicable to other like applications, devices, and methods of manufacture.

BACKGROUND

By way of background, this invention relates to improvements in floating basketball hoop pool devices. Generally, stabilizing a basketball hoop on the surface of a swimming pool is challenging. Further, playing basketball with floating basketball hoops often leads to hoops tipping over with water movement when individuals splash around in nearby areas of the pool, causing the ball to hit the rim of the hoop and not going in the basket, which creates frustration for those playing. Users need a floating basketball hoop with increased stability to create a more enjoyable and leisurely experience.

Further, after anticipating an enjoyable day in the water playing basketball with friends and family, engaging in game of basketball in the water with a hoop that continuously topples over and needs adjustment creates frustration. Typically, pool basketball hoops that float are poorly constructed and break easily with overuse or after a storm or other inclement weather occurrence. Often, after multiple failed attempts to adjust and balance the floating basketball hoop in the desired water area, it may become particularly burdensome, and users may ultimately abandon the activity. Finally, floating basketball hoops that are poorly constructed and lack stability continuously topple over, potentially creating injury to users by falling or colliding into each other or the floating basketball hoop.

Accordingly, there is a demand for an improved pool basketball hoop device. More particularly, there is a demand for a floating pool basketball hoop device that does not tip over when the ball hits the rim or when individuals are splashing in the pool in the surrounding area.

Therefore, there exists a long felt need in the art for a stable and free-floating basketball hoop for swimming pools device that provides users with a floating basketball hoop to be used in swimming pools or other recreational water areas. There is also a long felt need in the art for a stable and free-floating basketball hoop device that comprises extendable floats to provide additional stability. Moreover, there is a long felt need in the art for a device that is manufactured with a durable plastic frame or other material known in the art. Specifically, there is a long felt need in the art for a floating basketball hoop device that is manufactured with materials that are mold and water resistant and designed with antimicrobial materials to prevent the growth of bacteria. Further, there is a long felt need in the art for a stable and free-floating basketball hoop device that comprises an adjustable frame to provide an optimal experience for users of varying size or height, skill level, and desired outcome. Finally, there is a long felt need in the art for a floating basketball device that can be universally utilized in any pool, beach, or water area.

The subject matter disclosed and claimed herein, in one embodiment thereof, comprises a stable and free-floating basketball hoop device. The device is a specialized floating basketball hoop that improves the overall experience for users while participating in a game of basketball in a pool, a lake, or other water area. The floating basketball hoop device comprises a body component that can collapse for storage. The fabric of the hoop net is manufactured with a durable, mold resistant material to prevent the growth of bacteria. Further, the fabric net can be removed for cleaning, replacement, and storage. The circular shaped net, preferably manufactured in polyester, nylon, or other known fabric in the art, is secured to the basketball hoop with the openings around the top of the woven net. Finally, the device comprises water-resistant electrical component for keeping score and time, providing an enjoyable leisurely atmosphere for those participating.

In this manner, the floating basketball hoop device of the present invention accomplishes all of the forgoing objectives and provides users with a device that provides a stable and free-floating basketball hoop for a pool, beach, or other swimming area. The device has a base configured in a triangular shape for stability. The device can be collapsed for case of storage/transportation.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a stable and free-floating basketball hoop device. The device is a specialized floating basketball hoop for pools or other water areas that does not tip over when in use. The stable and free-floating basketball hoop device comprises a frame component that includes a rim and base connected with supporting arms for stability. The rim is circular in shape to accommodate any conventional basketball net. Further, the base is triangular in shape with at least one notch cut out for added stability. Moreover, the frame is preferably manufactured from a durable plastic such as but not limited to PVC pipe.

The present invention is directed to a stable and free-floating basketball hoop device that has particular utility. In the present invention, the stable and free-floating basketball hoop device can be utilized in any size pool, lake, or water surface. Although the device is generally used in swimming pools, the device may be used in a variety of swimming areas. Accordingly, the floating basketball hoop device is collapsible and easy to transport to store and transport.

In one embodiment, the floating basketball device comprises a body component that has a circular rim frame. Further, the circular frame is preferably made with, but not limited to PVC pipe. Moreover, the rim is preferably designed, but not limited to a diameter of 18 inches. Further, the rim component circle is formed with at least one bell and elbow shaped pipe connected to at least one other bell and elbow shaped pipe with at least one t-shaped PVC pipe fitting. Thus, the rim can be expanded or scaled down to the desired level of the individual, using a telescoping pole design. Further, a telescope pole design system, preferably manufactured with fiberglass or other lightweight material, enables for the rim component to expand, retract, and collapse for easy storage.

In one embodiment, the floating basketball hoop device is comprised of a triangular shaped base. The base component is comprised of at least one bell and elbow pipe. Further, at least one bell and elbow pipe is connected to at least one bell and elbow pipe using at least one t-shaped PVC pipe connector. In another embodiment, the base component and rim component are connected with at least one PVC side support pipe. Moreover, at least one PVC side support pipe is connected to the rim with at least one t-shaped PVC pipe connector. Further, at least one PVC side support pipe is connected to the base of the device with at least one t-shaped PVC pipe connector. When the side component is expanded or retracted using a telescoping pole design, the rim component diameter varies to meet a user's desired width and height. Finally, a telescoping pole design system, preferably manufactured with fiberglass or other lightweight material, enables the rim component and the base component to expand and/or retract with ease.

In one embodiment, the floating basketball device comprises a body component that has a base frame with at least one extended notch section. The base component is designed in a triangular shape, or three-legged shape, with at least one expandable notch section for increased stability. Moreover, the base component notch section side is formed with at least one straight PVC pipe. Further, the base component notch section top is formed with at least one straight PVC pipe. Finally, at least one straight side pipe and at least one top side pipe are connected using at least one elbow PVC pipe, providing increased stability while playing basketball in a body of water.

In one embodiment, the floating basketball hoop device comprises a foam sleeve for added support. Typically, the device base is comprised of at least one notched section. Further, the notch section is comprised of at least one side and at least one foam sleeve. Specifically, at least one foam sleeve is slid onto at least one side, providing enhanced support and buoyancy to the device while in water.

In one embodiment, the floating basketball hoop device is comprised of a net. Further, the net hangs from the rim component, using loops or openings around the circumference of the woven net. Typically, the net component is preferably manufactured of a durable nylon or polyester fabric or other known material in the art. Further, the net may be manufactured with a mold resistant material to prevent the growth of bacteria. Specifically, the fabric net slides onto the rim component and hangs, creating a "basket" for the ball to slide through. Further, the fabric net can be removed for cleaning, replacement, and storage.

In one embodiment, the floating basketball hoop device is comprised of a scoreboard. Further, the scoreboard component is preferably manufactured with a durable plastic that is airtight to prevent water from entering the component. Moreover, the scoreboard component is designed to be water resistant, and battery operated for ease and convenience. The battery is a rechargeable battery and is preferably a USBC rechargeable battery for powering the scoreboard. Moreover, the scoreboard component can electronically keep score and time. Further, the scoreboard component has a time and utilizes a buzzer sound to indicate when time has expired. Finally, the scoreboard component is attached to the rim of the device with a fastener. The attachment fastener is preferably a clip like mechanism, including, but not limited to a clamp, strap, or clasp.

In one embodiment, the floating basketball device comprises a carrying case with at least one handle for ease of storage and transportation. The carrying case component is preferably manufactured from a water and mold resistant fabric such as, but not limited to polyester or nylon. Typically, when the floating basketball hoop is not in use, it is in a collapsed flattened state to conform to the carrying case. Further, the carrying case enables for compact storage and easy transportation.

In yet another embodiment, the floating basketball hoop device carrying case comprises a plurality of indicia.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
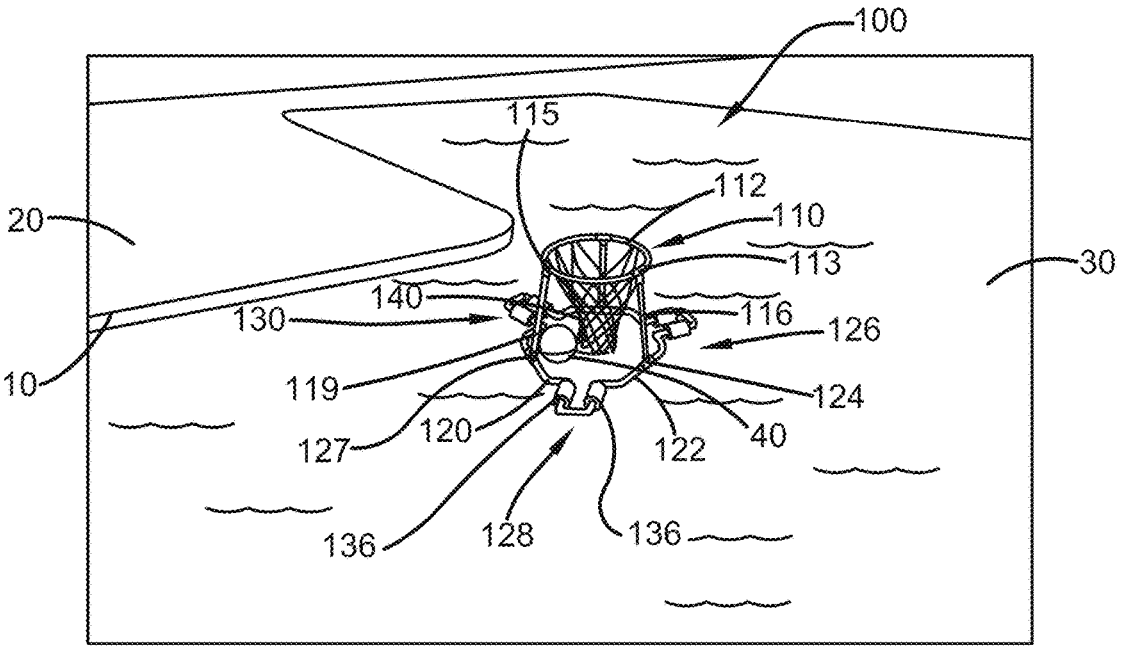
FIG. 1 illustrates a perspective view of one embodiment of the stable and free-floating basketball hoop for pools device of the present invention showing the device floating in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a stable and free-floating basketball hoop for pools device. There is also a long felt need for a stable and free-floating basketball hoop device that provides users with a floating basketball hoop to be used in swimming pools or other recreational water areas. There is also a long felt need in the art for a stable and free-floating basketball hoop device that comprises extendable notches with foam sleeves to provide additional stability. Moreover, there is a long felt need in the art for a device that is manufactured with a durable plastic frame or other material known in the art. Specifically, there is a long felt need in the art for a floating basketball hoop device that is manufactured with materials that are mold and water resistant and designed with antimicrobial materials to prevent the growth of bacteria. Further, there is a long felt need in the art for a stable and free-floating basketball hoop device that comprises an adjustable frame to provide an optimal experience for users of varying size or height, skill level, and desired outcome. Finally, there is a long felt need in the art for a floating basketball device that can be universally utilized in any pool, beach, or water area.

The present invention, in one exemplary embodiment, is a novel stable and free-floating basketball hoop device. The stable and free-floating basketball hoop device comprises a body component that is configured in a rectangular shape base, a circular shaped rim, woven net, scoreboard component, and carrying case. The woven fabric comprises a plurality of openings around the circumference to hang from the rim. Moreover, the device comprises an electrical scoreboard component that attaches to the rim of the device and is rechargeable. The device can collapse via a telescoping pole design for storage and transport. Further, the present invention also includes a novel method of easily storing and transporting the device. The method includes the steps of providing a stable and free-floating basketball hoop pool device comprising a frame component with rim, base, net, foam sleeves, and carrying case. Next, the method comprises expanding the base and rim via the telescoping pole design. Further, the method also comprises securing the woven net to the rim via the openings around the circumference of the woven net. The method also comprises attaching the foam sleeves on the sides of the notches in the base. The method also comprises attaching the rechargeable scoreboard component to the rim with fasteners. The method also comprises removing the scoreboard component and woven net. The method also includes collapsing the frame component. Finally, the method comprises inserting the collapsed device into the carrying case for storage.

Figure 2:
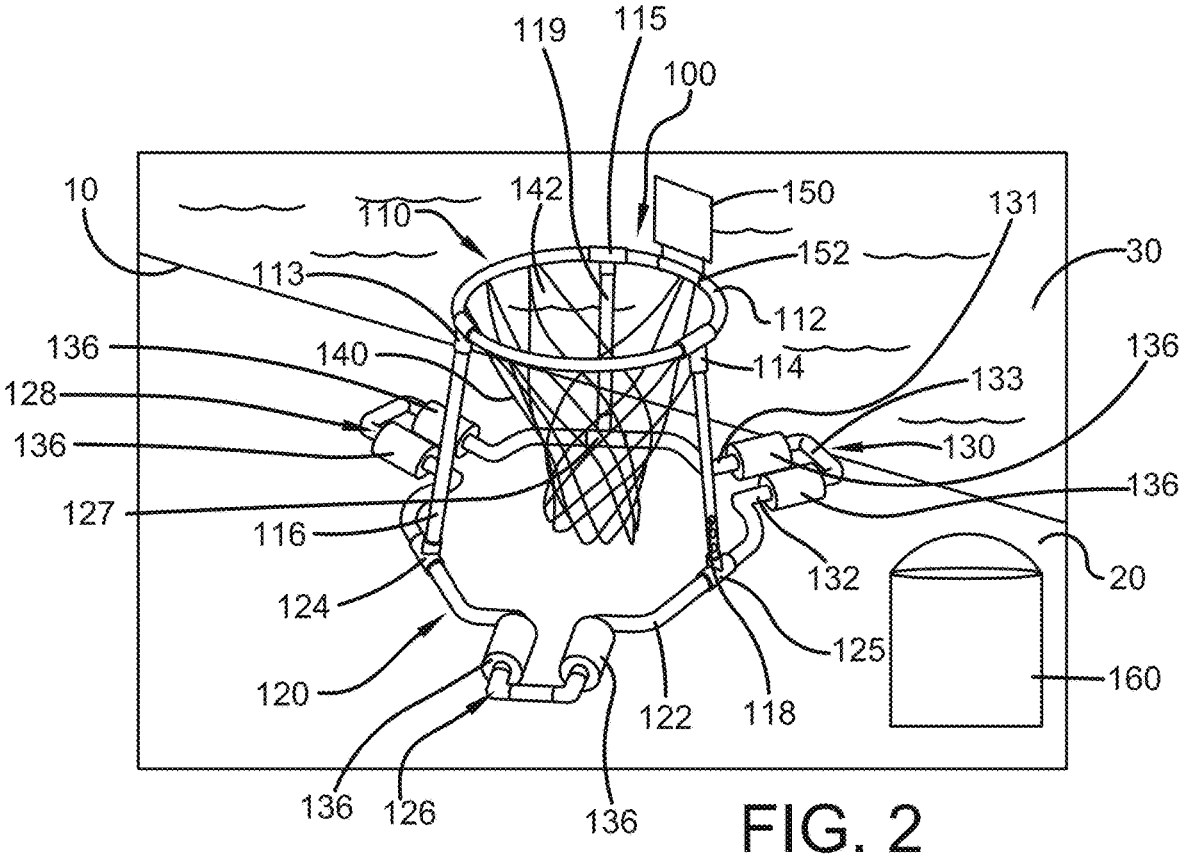
FIG. 2 illustrates a perspective view of one embodiment of the stable and free-floating basketball hoop for pools device of the present invention showing the device on a patio in accordance with the disclosed architecture.

Referring initially to the drawings, FIGS. 1-2 illustrate a perspective view of one embodiment of the stable and free-floating basketball hoop for pools device 100 of the present invention. In the present embodiment, the stable and free-floating basketball hoop for pools device 100 is an improved floating basketball hoop device 100 that provides a user with an enhanced experience for playing basketball in a swimming pool. The device 100 comprises a rectangular or circular shaped base component 120 and a rim 110. The base 120 and rim 110 are manufactured from PVC pipe or durable plastic pipe.

Specifically, the stable and free-floating basketball hoop device 100 comprises a base component 120 with a rim 110, a woven net 140, and at least one foam sleeve 136. The woven net is preferably manufactured with a mold resistant fabric, such as but not limited to polyester or nylon. The net 140 is secured to the rim 110 via through openings 142 during use. The rim 110 is constructed with at least one bell end connecting pipe 112 and at least one t-shaped pipe connector 113, 114, 115. Further, the rim 110 is connected to a plurality of telescoping support pipes 116, 118, 119 using the at least one t-shaped pipe connector 113, 114, 115. Moreover, the rim 110 and at least one side support pipe 116, 118, 119 are connected to the base 120 using at least one t-shaped pipe connector 124, 125, 127. Finally, the notches or orthogonally extending floating supports 126, 128, 130, i.e., extending orthogonally outward from the base 120, along with at least one foam sleeve 136, provide enhanced stability and buoyancy for the device 100. Typically, the foam sleeve(s) 136 is manufactured from polyethylene, but is not limited to this material and any other suitable material may also be used.

Specifically, the present invention is directed to stable and free-floating basketball hoop for pools device 100 that has particular utility in a variety of swimming areas, such as a pool 10, lake, and other water area. In the present invention, the tip-over-free basketball hoop pool device 100 can be adjusted in height and circumference to meet the desired comfort level of the user 50. The rim 110 and the bell end connecting pipe 112 of the device 100 is designed to telescope (i.e., expand a diameter and circumference) from about 10 inches in diameter to about 24 inches in diameter. In addition, the device 100 adapts to various users 50 with varying heights. More specifically, the device 100 can accommodate a plurality of ball 40 sizes and users when the diameter of the rim 110 is adjusted using the telescoping rim 110 and the height of the rim 110 is adjusted using telescoping poles 116, 118, 119. Accordingly, the basketball hoop device 100 has a telescoping pole 116, 118, 119 design system in order to increase or decrease the height or distance between the rim 110 and the base 120 to accommodate various users 50. Further, the device 100 comprises a scoreboard component 150 for added enjoyment for users 50. Specifically, the scoreboard component 150 is preferably manufactured with an airtight plastic or other water-resistant material for durability. Further, the scoreboard component 150 is attached to the rim 110 of the device 100 with at least one fastener 152, such as but not limited to a clip or clasp. Moreover, the scoreboard component 150 tracks score, time, and is rechargeable for an enhanced experience. Finally, the device 100 can be collapsed using the telescoping poles 116, 118, 119 design and placed into a carrying case 160 for storage.

Figure 3:
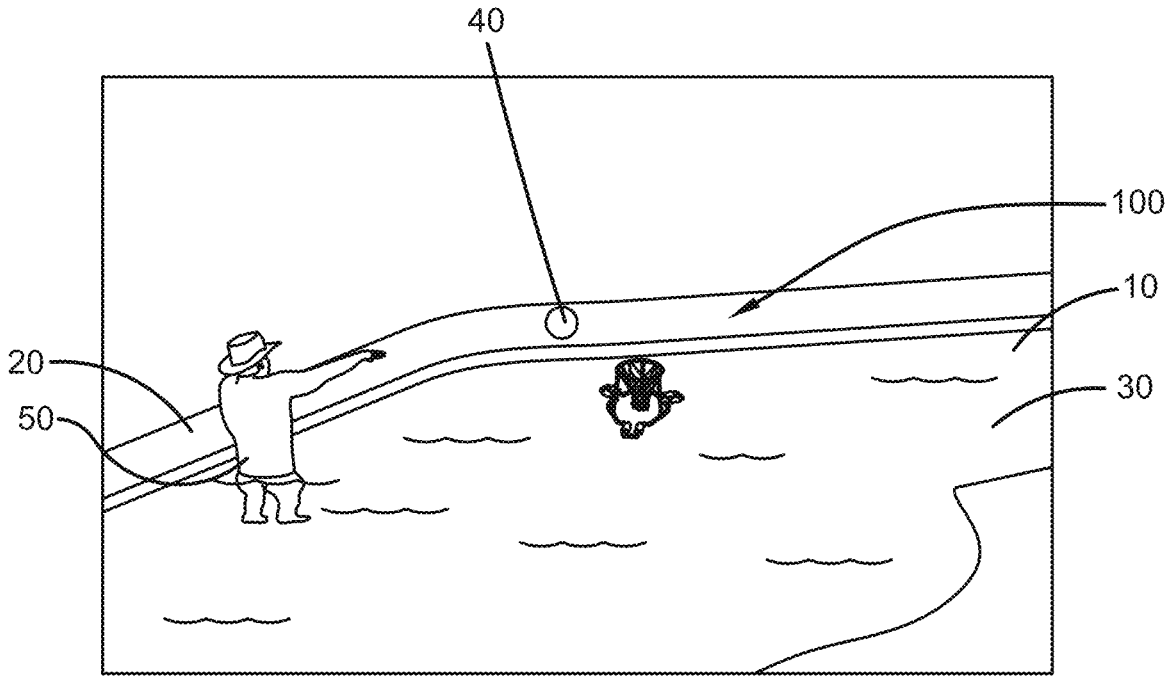
FIG. 3 illustrates a perspective view of one embodiment of the stable and free-floating basketball hoop for pools device of the present invention showing the device in use in accordance with the disclosed architecture.
Figure 4:
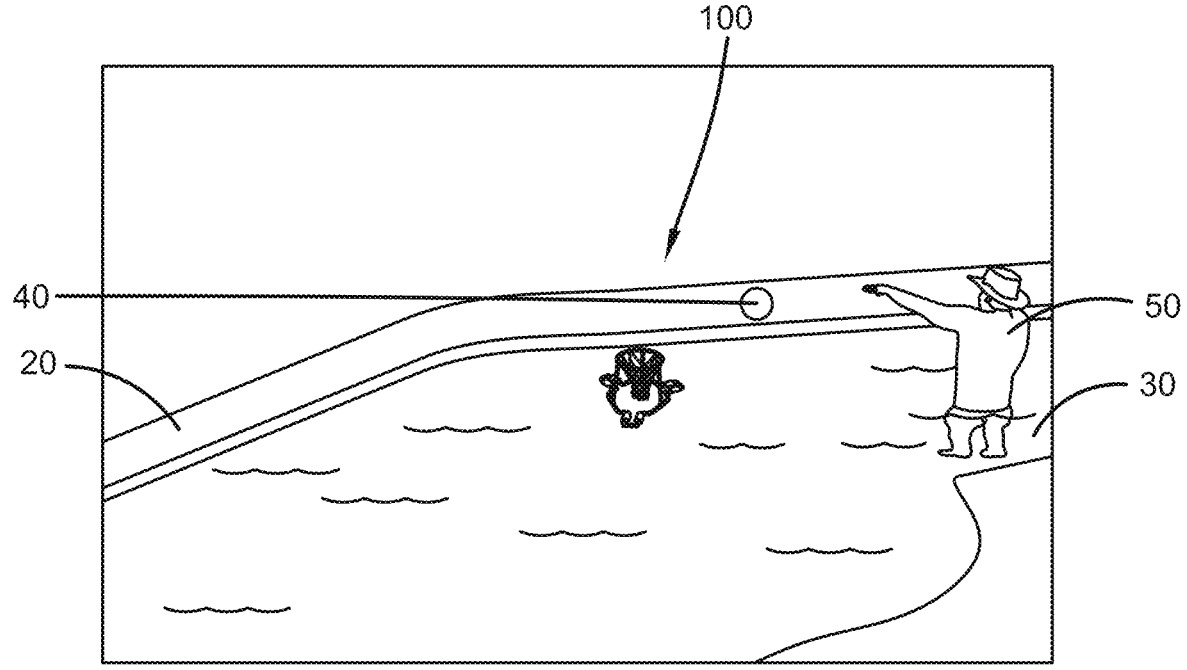
FIG. 4 illustrates a perspective view of one embodiment of the stable and free-floating basketball hoop for pools device of the present invention showing yet another view of the device in use in accordance with the disclosed architecture.

As shown in FIGS. 3-4, the stable and free-floating basketball hoop device 100 comprises a base component 120 that is configured in a rectangular or circular shape for increased stability and buoyancy. The device 100 comprises a rectangular, circular, or triangular shaped base component 120 and a rim 110. Generally, a user 50 will throw or toss a ball 40 toward the device 100, trying to get the ball 40 to go through the rim 110 of the device 100. Typically, movement in the pool 10 from other individuals creates rough water 30. The stable and free-floating basketball hoop device 100 is designed as a rectangular or circular shaped base 120, having a triangular arranged notch supports 126, 128, 130, and a foam sleeve(s) 136 to prevent the device 100 from toppling over. The notch supports 126, 128, 130 extend orthogonally away from the base 120. The notch supports 126, 128, 130 each include a pair of opposing legs and a connecting arm. For example, notch support 130 includes opposing legs 131, 132 and connecting arm 133. The base 120 includes a bell end connecting pipe 122 for assembling and disassembling the base 120. It is to be appreciated that each leg and arm can include a foam sleeve 136 for stabilizing and prohibiting tipping of the hoop device 100. As shown in FIG. 2, foam sleeves 136 are connected to all legs of the notch supports 126, 128, 130.

Further, the device 100 remains upright once the ball 40 has cleared the rim 110 and entered the woven net 140. Moreover, moving water 30 in the pool does not cause the device 100 to topple over. More specifically, the triangular shaped base 120, notch supports 126, 128, 130, and foam sleeves 136 increase the stability of the device 100.

Figure 5:
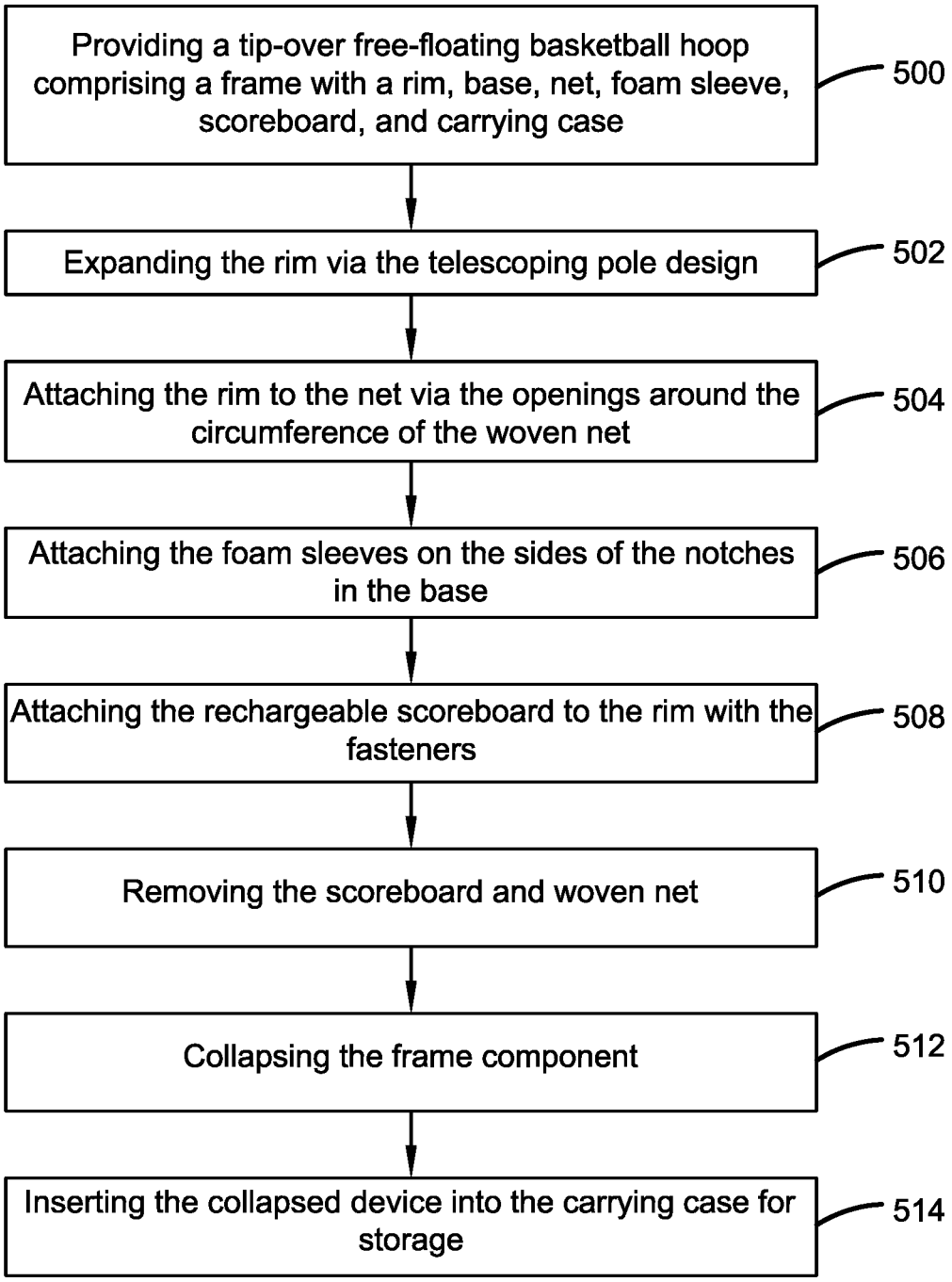
FIG. 5 illustrates a flowchart showing the method of using the device and storing the device in accordance with the disclosed architecture.

FIG. 5 illustrates a flowchart of the method of using and storing the floating basketball device. The method includes the steps of at 500, providing a stable and free-floating basketball hoop device comprising a frame with a base, rim, net, foam sleeve, and carrying case. The method also comprises at 502, expanding the rim and base via the telescoping pole design system. Further, the method comprises at 504, attaching the net to the rim via the openings around the circumference of the woven net. The method also comprises at 506, attaching the foam sleeves on the sides of the notches in the base. The method also comprises at 508, attaching the rechargeable scoreboard to the rim with fasteners. Further, the method comprises at 510 removing the scoreboard component and woven net. The method also comprises at 512 collapsing the frame component. Finally, the method comprises at 514, inserting the collapsed device into the carrying case for storage.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "stable and free-floating basketball hoop for pools device", "basketball hoop device", "floating basketball hoop", and "device" are interchangeable and refer to the stable and free-floating basketball hoop for pools device 100 of the present invention.

Notwithstanding the forgoing, the stable and free-floating basketball hoop for pools device 100 of the present invention can be of any suitable size and configuration as is known in the art without affecting the overall concept of the invention, provided that it accomplishes the above stated objectives. One of ordinary skill in the art will appreciate that the stable and free-floating basketball hoop for pools device 100 as shown in FIGS. 1-6 is for illustrative purposes only, and that many other sizes and shapes of the stable and free-floating basketball hoop for pools device 100 are well within the scope of the present disclosure. Although the dimensions of the stable and free-floating basketball hoop for pools device 100 are important design parameters for user convenience, the stable and free-floating basketball hoop for pools device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A stable and free-floating basketball hoop comprising:
a base;
a plurality of notch supports;
a rim;
a plurality of telescoping supports;
a woven net; and
a plurality of foam sleeves;
wherein said base and said rim having a material selected from the group consisting of a PVC pipe and a plastic pipe;
wherein said telescoping supports connect said rim and said base at a selectable height;
wherein said plurality of notch supports extending orthogonally away from said base;
wherein each of said plurality of notch supports having a pair of opposing legs; and
further wherein each of said opposing legs having a foam sleeve wrapped therearound.

2. The stable and free-floating basketball hoop of claim 1, wherein said rim having at least one bell end for telescoping selectively said rim to set a diameter of said rim between 10 inches and 24 inches.

3. The stable and free-floating basketball hoop of claim 1, wherein said woven net having a material selected from the group consisting of a mold resistant fabric, a polyester, and a nylon.

4. The stable and free-floating basketball hoop of claim 3, wherein said woven net selectively securable to said rim.

5. The stable and free-floating basketball hoop of claim 1, wherein said plurality of notches spaced equidistant around said base.

6. The stable and free-floating basketball hoop of claim 5, wherein each of said plurality of telescoping supports connected between said rim and said base with opposing t-shaped pipe connectors.

7. The stable and free-floating basketball hoop of claim 5, wherein said plurality of notches form corners of a virtual triangle.

8. The stable and free-floating basketball hoop of claim 1, wherein said base component form portions of a virtual rectangle.

9. The stable and free-floating basketball hoop of claim 7, wherein said base component form portions of a virtual circle.

10. A stable and free-floating basketball hoop comprising:
a base;
a plurality of notch supports;
a rim;
a plurality of telescoping supports;
a woven net; and
a plurality of foam sleeves;
wherein said base and said rim having a material selected from the group consisting of a PVC pipe and a plastic pipe;
wherein said telescoping supports connect said rim and said base at a selectable height;
wherein said plurality of notch supports extending orthogonally away from said base;
wherein each of said plurality of notch supports having a pair of opposing legs;
wherein each of said opposing legs having a foam sleeve wrapped therearound;
wherein said rim having at least one bell end for telescoping selectively said rim to set a diameter of said rim between 10 inches and 24 inches;
wherein each of said plurality of telescoping supports connected between said rim and said base with opposing t-shaped pipe connectors; and
further wherein said plurality of notches form corners of a virtual triangle.

11. The stable and free-floating basketball hoop of claim 10, wherein said woven net having a material selected from the group consisting of a mold resistant fabric, a polyester, and a nylon.

12. The stable and free-floating basketball hoop of claim 10, wherein said woven net selectively securable to said rim.

13. The stable and free-floating basketball hoop of claim 10, wherein said plurality of notches spaced equidistant around said base.

14. The stable and free-floating basketball hoop of claim 10, wherein said base form portions of a virtual circle.

15. A collapsible and portable free-floating basketball hoop comprising:
a base;
a plurality of notch supports;
a telescoping rim;
a plurality of telescoping supports;
a woven net; and
a plurality of foam sleeves;
wherein said base and said telescoping rim having a material selected from the group consisting of a PVC pipe and a plastic pipe;
wherein said telescoping supports connect said telescoping rim and said base at a selectable height;
wherein said plurality of notch supports extending orthogonally away from said base;
wherein each of said plurality of notch supports having a pair of opposing legs and a connecting arm between said pair of opposing legs;
wherein each of said opposing legs having a foam sleeve wrapped therearound;
wherein each of said plurality of telescoping supports connected between said rim and said base with opposing t-shaped pipe connectors; and
further wherein said plurality of notches spaced equidistant around said base.

16. The stable and free-floating basketball hoop of claim 15, wherein said woven net selectively securable to said rim.

17. The stable and free-floating basketball hoop of claim 15, wherein said telescoping rim having a waterproof scoreboard connected thereto.

18. The stable and free-floating basketball hoop of claim 15, wherein said telescoping rim having at least one bell end for telescoping selectively said telescoping rim to set a diameter of said rim between 10 inches and 24 inches.

19. The stable and free-floating basketball hoop of claim 15, wherein said base form portions of a virtual rectangle.

* * * * *